US005519923A

United States Patent [19]

Rojdev et al.

[11] Patent Number: 5,519,923

[45] Date of Patent: May 28, 1996

[54] NON-INVASIVE EXTERNALLY REMOVABLE CASKET HARDWARE

[75] Inventors: Ilija Rojdev, Fairfield; Dennis C. Laphan, Cincinnati, both of Ohio

[73] Assignee: Batesville Casket Company, Inc., Batesville, Ind.

[21] Appl. No.: 410,873

[22] Filed: Mar. 27, 1995

[51] Int. Cl.[6] ..... A61G 17/00

[52] U.S. Cl. ..... 27/1; 16/114 R; 16/DIG. 24; 27/27

[58] Field of Search ..... 27/1, 2, 27, 35; 16/112, 114 R, DIG. 24; 403/109, 322, 374

[56] References Cited

U.S. PATENT DOCUMENTS

| | | | |
|---|---|---|---|
| 4,615,085 | 10/1986 | Hartman | 27/1 |
| 5,144,727 | 9/1992 | Craft . | |
| 5,377,395 | 1/1995 | Maier et al. . | |

OTHER PUBLICATIONS

Southco Fasteners Handbook, Southco, Inc. Concordville, PA ©1990, 5 pages.

*Primary Examiner*—Kien T. Nguyen

*Attorney, Agent, or Firm*—Wood, Herron & Evans

[57] ABSTRACT

The combination of a casket and non-invasive externally removable hardware for lifting the casket. The combination comprises a casket shell including a socket in a wall thereof, a plate, a handle operably connected to the plate for lifting the casket, a stud passing through the plate, means for translating the stud relative to the plate, a retainer connected to the stud, and resilient material surrounding the stud and disposed between the plate and the retainer. The handle, when the stud is inserted into the casket shell wall socket, is removably securable to the casket shell upon actuation of the translating means to translate the stud and retainer toward the plate compressing the resilient material therebetween and causing the resilient material to swell to fill the socket. In a preferred form, the plate has opposed surfaces and the stud has opposed ends, and the translating means comprises a cam pivotally connected to one of the stud ends and actuatable against one of the plate surfaces to translate the stud relative to the plate. The plate is a part of a clevis and the handle is a handle bar connected to an arm which is pivotally connected to the clevis. The stud is a threaded bolt and the retainer is a mateably threaded nut threaded onto the bolt. The resilient material is an elongated rubber bushing.

18 Claims, 1 Drawing Sheet

NON-INVASIVE EXTERNALLY REMOVABLE CASKET HARDWARE

FIELD OF THE INVENTION

This invention relates generally to burial caskets, and more particularly to non-invasive externally removable hardware for burial caskets.

BACKGROUND OF THE INVENTION

A metal casket is formed as a deep, hollow metal shell which is closed by a cap. Much effort is expended to provide that the casket is leak tight so that water cannot leak into the casket when the casket is buried underground. It is also important that liquids of body decomposition not leak out of the casket when the casket is disposed in a mausoleum. Similarly, it is desirable that caskets not evidence bodily dissolution during funeral services, transport, etc. Special gaskets have been designed for the engagement of the cap with the shell to prevent leaking around the perimeter of the casket. One of the final steps in the manufacturing process of the casket is to pressure test the casket with the lid closed upon its shell to determine whether the casket, before it is shut, is indeed leak tight. Alternatively the shell can be filled with water to test its integrity.

The casket hardware represents a potential site for leakage. Conventionally, holes are drilled or stamped through the wall of the casket shell. Bolts pass through those holes to mount the hardware to the shell, the hardware providing the handles by which the casket is carried. Washers must be mounted on the bolts to provide a seal around the holes.

The hardware is the point of greatest stress when the casket is handled. There is always the potential for the rupture of the leak-tight seal around each bolt that attaches the hardware to the shell. Eventually, the corrosive effects of body acids, soil conditions etc. will deteriorate the bolt to the point that the seal around the bolt hole is compromised. Wherever a hole is formed in a casket, the potential for a leak exists.

It is therefore one objective of the present invention to provide non-invasive hardware for a casket, that is, hardware that can be mounted on the casket without the necessity of drilling a hole in the casket wall.

Wood caskets similarly have externally mounted metal hardware. When wood caskets having standard metal hardware are cremated, the metal hardware is a source of problems. The external hardware on caskets are often die cast parts which include zinc as a major component. During cremation, the zinc in the metal hardware tends to damage and deteriorate the fire brick of the crematory. Furthermore, during the cremation process the melting and decomposition of the zinc can yield undesirable gases. As a result, the cremation industry is making attempts to eliminate the production of these gases during the cremation process.

The use of metal hardware on caskets presents other problems during cremation. During the cremation of caskets having metal hardware, incidental human remains such as bone fragments tend to sear and attach to the molten metal presenting disposal problems and thereby further complicate the cremation process. Specifically, external metal casket hardware which is stamped steel does not melt during the cremation process but does sear to bone fragments. Due to its mass the stamped steel hardware is a nuisance to remove from the remains when it is still hot in the cremation process.

Additionally, the ornamental and functional metal hardware used on a wood casket can be expensive to manufacture and incorporate into the casket.

Complicating matters is the requirement that after the casket lid has been closed and locked, for example, subsequent to the memorial service, the casket may not be unlocked and the lid opened to remove the external casket hardware by removing the fasteners which can only be accessed from the interior of the casket. The current practice at many crematories is to use a pry bar or saber saw to remove the hardware externally.

It is therefore another objective of the present invention to provide externally removable casket hardware which can be completely removed subsequent to the memorial services and prior to the cremation process without opening the casket thereby eliminating introduction of metal hardware into the crematory.

It is yet another objective of the present invention to provide externally removable casket hardware which can be removed prior to cremation and then reused by reattachment of the hardware on other caskets.

Still another objective of the present invention has been to provide such non-invasive externally removable casket hardware without sacrificing the strength and integrity of the hardware when mounted to the casket.

A further objective of the present invention is to provide casket hardware conducive to ready-to-assemble ("RTA") manufacturing techniques such that the hardware can be assembled onto the casket without disturbing any pre-installed interior components such as linings and the like.

SUMMARY OF THE INVENTION

The present invention attains the stated objectives by providing the combination of a casket and non-invasive externally removable hardware for lifting the casket. The combination comprises a casket shell including a socket in a wall thereof, a plate, a handle operably connected to the plate for lifting the casket, a stud passing through the plate, means for translating the stud relative to the plate, a retainer connected to the stud, and resilient material surrounding the stud and disposed between the plate and the retainer. The handle, when the stud is inserted into the casket shell wall socket, is removably securable to the casket shell upon actuation of the translating means to translate the stud and retainer toward the plate compressing the resilient material therebetween and causing the resilient material to swell to fill the socket.

In a preferred form of the present invention, the plate has opposed surfaces and the stud has opposed ends, and the translating means comprises a cam pivotally connected to one of the stud ends and actuatable against one of the plate surfaces to translate the stud relative to the plate. The plate is a part of a clevis and the handle is a handle bar connected to an arm which is pivotally connected to the clevis. The stud is a threaded bolt and the retainer is a mateably threaded nut threaded onto the bolt. The resilient material is an elongated rubber bushing.

One advantage of the present invention is that non-invasive hardware for a casket is provided which can be mounted on the casket without the necessity of drilling a hole in the casket wall.

Another advantage of the present invention is that externally removable casket hardware is provided which be completely removed subsequent to the memorial services and prior to the cremation process without opening the casket thereby eliminating introduction of metal hardware into the crematory.

Yet another advantage of the present invention is that externally removable casket hardware is provided which can be removed prior to cremation and then reused by reattachment of the hardware on other caskets.

Still another advantage of the present invention is that non-invasive externally removable casket hardware is provided which does not sacrifice the strength and integrity of the hardware when mounted to the casket.

These and other objects and advantages of the present invention will become more readily apparent during the following detailed description taken in conjunction with the drawings herein, in which:

DETAILED DESCRIPTION OF THE INVENTION

Figure 1:
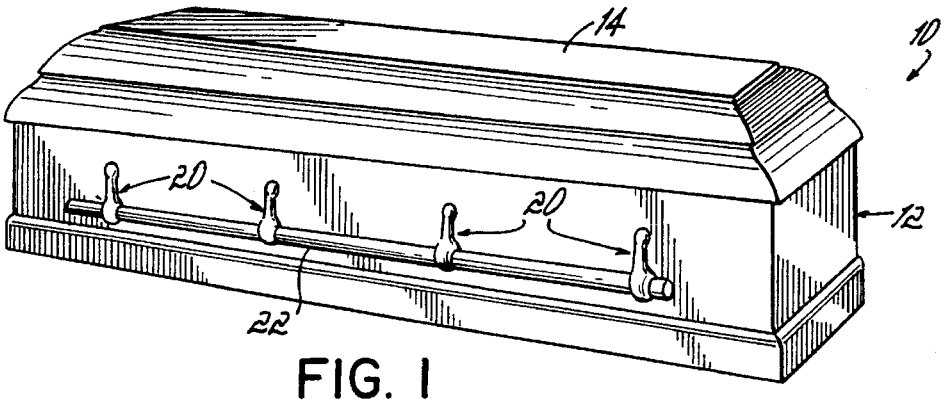
FIGS. 1 is a perspective view of a casket including the hardware of the present invention.

Referring first to FIG. 1, there is illustrated a casket 10 according to the principles of the present invention. The casket 10 includes a shell 12 and a cap 14 pivoted to the shell 12 by means not shown but known to those skilled in the art.

Figure 2:
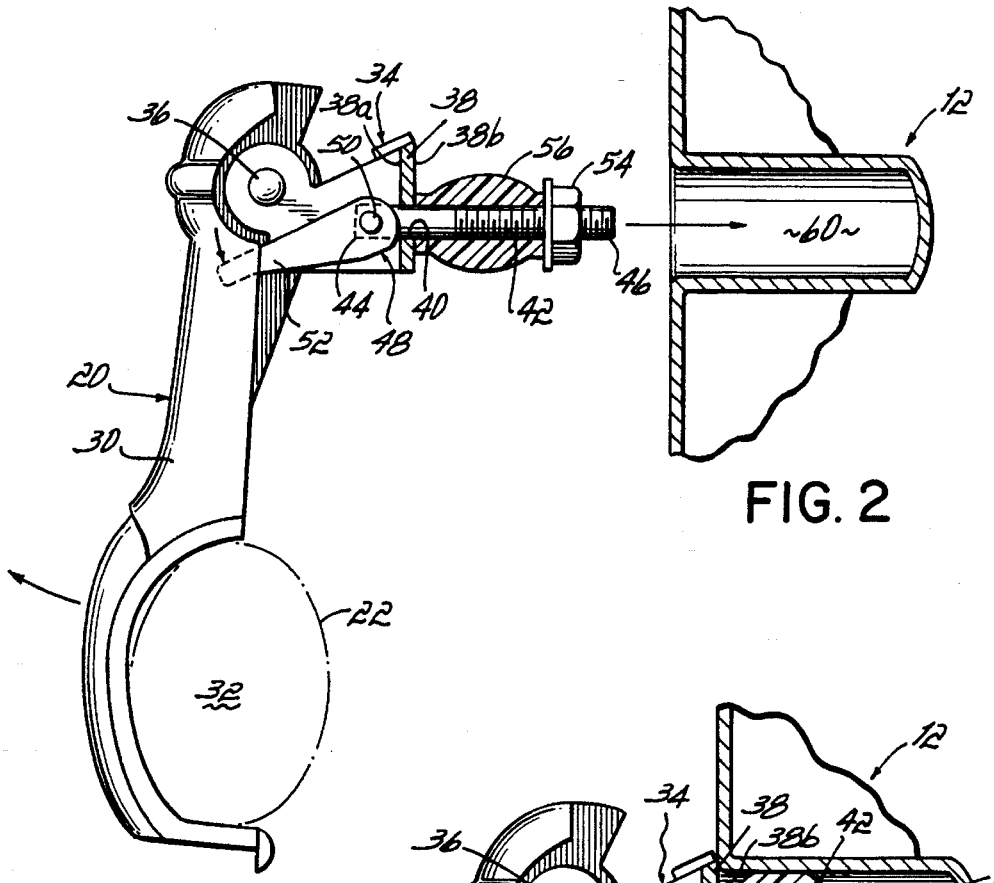
FIG. 2 is a partial cross-sectional view of a portion of the casket shell and the hardware of the present invention prior to installation.
Figure 3:
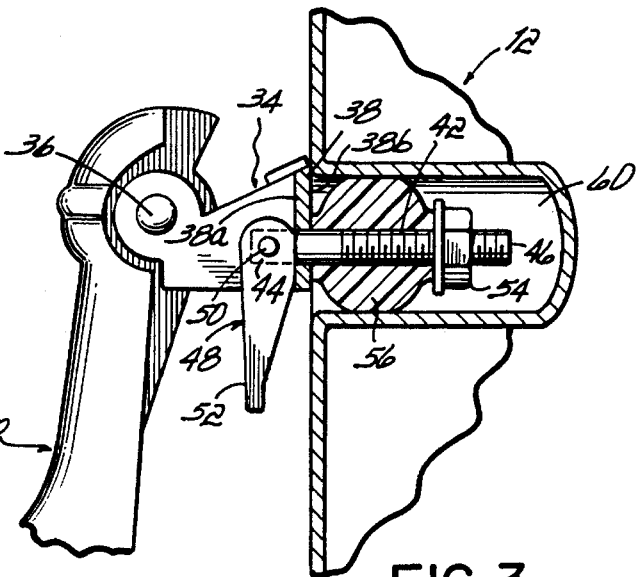
FIG. 3 is view similar to FIG. 2 but with the hardware installed onto the casket shell.

A plurality of arm assemblies 20 attach a handle bar 22 to the casket shell 12. Referring now to FIGS. 2 and 3, each arm assembly 20 cooperates with the casket shell 12 as is shown in more detail. The arm assembly 20 includes an arm 30 which is adapted to receive and support the handle bar 22 as shown at 32. Arm 30 is pivotally connected to a clevis 34 via rivet 36. Clevis 34 includes a clevis plate 38 which includes a hole 40 therethrough. A threaded stud 42 passes through hole 40 and has opposed ends 44 and 46. A cam 48 is pivoted to end 44 of stud 42 via rivet 50. Cam 48 includes a lever 52 for actuation thereof. A mateably threaded nut 54 is threaded onto end 46 of the stud 42. An elongated rubber bushing 56 surrounds the stud 42 and is disposed between the clevis plate 38 and the nut 54. Cam 44 is actuatable against surface **38*a* of clevis plate 38 to translate the stud 42 and hence nut 54 towards the clevis plate 38 and to compress the rubber bushing 56** therebetween.

Casket shell 12 includes a socket 60 formed therein which accepts the stud 42 and bushing 56 therein. While casket shell 12 is illustrated as a sheet metal shell with socket 60 formed therein, it will be appreciated that the present invention could as well be utilized with a wooden casket having a wooden shell wherein a socket is bored into the casket wall. In thinner, less dense woods a metal sleeve or so-called barrel nut could be inserted into the socket bored into the wood thus forming a socket or receptacle for retaining the expandable bushing therein.

In use, the lever 52 of the cam 48 is initially in the position shown in FIG. 2. The stud 42 with rubber bushing 56 thereon is inserted into the socket 60. Once completely inserted, the lever 52 is pushed downwardly to the position shown in FIG. 3. In so doing, the stud 42 and hence nut 54 are translated toward the clevis plate 38. Bushing 56 is compressed between the nut 54 and surface **38*b* of the clevis plate 38, thus swelling the bushing 56 to fill the socket 60 as shown in FIG. 3 thus removably securing the arm assembly 20 to the casket shell 12. To remove the arm assembly from the casket shell 12, the lever 52 of the cam 48 is simply moved to the position shown in FIG. 2, wherein the resiliency of the rubber bushing shrinks in diameter back to the initial configuration shown in FIG. 2 whereat the arm assembly 20 may be removed from the socket 60**.

Figure 4:
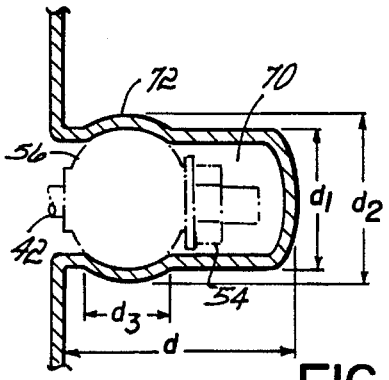
FIG. 4 is a view similar to FIG. 3 but illustrating an alternative form of socket for use with the hardware of the present invention.

Referring now to FIG. 4, there is illustrated an alternative preferred embodiment of the socket 60 for use with the hardware of the present invention, indicated generally at 70. Socket 70 is illustrated as being formed in a 16 gauge metal casket shell, which has a wall thickness of approximately 0.063–0.065 inch. Socket 70 has a depth dimension indicated at d of approximately 1.25 inches, a first diameter indicated at d1 of approximately 1 inch, and a second diameter at bulged or undercut region 72 and indicated at d2 of approximately 1.25 inches. Bulged region 72 itself has a depth dimension of approximately 0.75 inch as indicated at d3. Undercut or bulged region 72 provides a snug fit of rubber bushing 56 within socket 70, inhibiting the bushing 56 from pulling out of socket 70 during handling of the casket 10 by bar 22.

Rubber bushing 56 is preferably manufactured of a blend of neoprene and EPDM (ethylene-propylene-diene-methylene), having a temperature range of –30° F. to 200° F., a tensile strength of 1200 psi, a durometer hardness, Shore A: 50–60, and can be injection molded or cut to length from an extruded cylinder. Bushing 56 is further preferably approximately 0.875 inch in diameter and expands to approximately 1 inch in diameter during activation of cam handle 52. Stud 42 is preferably fabricated of 300 stainless steel and has a diameter of 0.1875 inch, or otherwise is a #10–24 bolt. Retaining nut 54 is preferably fabricated from cold formed carbon steel. Clevis 34 is preferably fabricated from 10 gauge carbon steel. Arm 30 and cam handle 52 are preferably fabricated from injection die cast zinc, #3 zinc alloy.

Those skilled in the art will readily recognize numerous adaptations and modifications which can be made to the casket and non-invasive externally removable hardware of the present invention which will result in an improved casket and hardware combination, yet all of which will fall within the spirit and scope of the present invention as defined in the following claims. Accordingly, the invention is to be limited only by the scope of the following claims and their equivalents.

What is claimed is:

1. A combination of a casket and non-invasive externally removable hardware for lifting said casket, said combination comprising:

a casket shell including a socket in a wall thereof;

a plate;

a handle operably connected to said plate for lifting said casket;

a stud passing through said plate;

means for translating said stud relative to said plate;

a retainer connected to said stud; and resilient material surrounding said stud and disposed between said plate and said retainer;

said handle, when said stud is inserted into said casket shell wall socket, being removably securable to said casket shell upon actuation of said translating means to translate said stud and retainer toward said plate compressing said resilient material therebetween and causing said resilient material to swell to fill said socket.

2. The combination of claim 1 wherein said plate has opposed surfaces and said stud has opposed ends, and wherein said translating means comprises:

a cam pivotally connected to one of said stud ends and actuatable against one of said plate surfaces to translate said stud relative to said plate.

3. The combination of claim 2 wherein said plate is a part of a clevis.

4. The combination of claim 3 wherein said handle is a handle bar connected to an arm which is pivotally connected to said clevis.

5. The combination of claim 4 wherein said stud is a threaded bolt and said retainer is a mateably threaded nut threaded onto said bolt.

6. The combination of claim 5 wherein said resilient material is an elongated rubber bushing.

7. A combination of a casket and non-invasive externally removable hardware for lifting said casket, said combination comprising:

a casket shell including a socket in a wall thereof;

a plate having opposed surfaces;

a handle operably connected to said plate for lifting said casket;

a stud passing through said plate, said stud having opposed ends;

a cam pivotally connected to one of said stud ends and actuatable against one of said plate surfaces to translate said stud relative to said plate;

a retainer connected to the other of said stud ends; and resilient material surrounding said stud and disposed between the other of said plate surfaces and said retainer;

said handle, when said stud is inserted into said casket shell wall socket, being removably securable to said casket shell upon actuation of said cam against said one plate surface to translate said stud and retainer toward said other plate surface compressing said resilient material therebetween and causing said resilient material to swell to fill said socket.

8. The combination of claim 7 wherein said plate is a part of a clevis.

9. The combination of claim 8 wherein said handle is a handle bar connected to an arm which is pivotally connected to said clevis.

10. The combination of claim 9 wherein said stud is a threaded bolt and said retainer is a mateably threaded nut threaded onto said bolt.

11. The combination of claim 10 wherein said resilient material is an elongated rubber bushing.

12. A combination of a casket and non-invasive externally removable hardware for lifting said casket, said combination comprising:

a casket shell including a socket in a wall thereof; and an arm assembly adapted to be removably securable to said casket shell wall, said assembly comprising:

an arm adapted to receive and support a handle bar for lifting said casket;

a clevis including a clevis plate having opposed surfaces, said arm being pivotally connected to said clevis;

a stud passing through said clevis plate, said stud having opposed ends;

a cam pivotally connected to one of said stud ends and actuatable against one of said clevis plate surfaces to translate said stud relative to said clevis plate;

a retainer connected to the other of said stud ends; and resilient material surrounding said stud and disposed between the other of said clevis plate surfaces and said retainer;

said arm assembly, when said stud is inserted into said casket shell wall socket, being removably securable to said casket shell upon actuation of said cam against said one clevis plate surface to translate said stud and retainer toward said other clevis plate surface compressing said resilient material therebetween and causing said resilient material to swell to fill said socket.

13. The casket of claim 12 wherein said stud is a threaded bolt and said retainer is a mateably threaded nut threaded onto said bolt.

14. The casket of claim 13 wherein said resilient material is an elongated rubber bushing.

15. Non-invasive externally removable hardware for lifting a casket having a casket shell including a socket in a wall thereof comprising:

a clevis including a plate having opposed surfaces and adapted to have operably connected thereto a handle for lifting the casket;

a stud passing through said plate, said stud having opposed ends;

a cam pivotally connected to one of said stud ends and actuatable against one of said plate surfaces to translate said stud relative to said plate;

a retainer connected to the other of said stud ends; and resilient material surrounding said stud and disposed between the other of said plate surfaces and said retainer;

said hardware, when said stud is inserted into the casket shell wall socket, being removably securable to the casket shell upon actuation of said cam against said one plate surface to translate said stud and retainer toward said other plate surface compressing said resilient material therebetween and causing said resilient material to swell to fill the socket.

16. The hardware of claim 15 further including an arm pivotally connected to said clevis and which is adapted to receive and support a handle bar for lifting the casket.

17. The hardware of claim 16 wherein said stud is a threaded bolt and said retainer is a mateably threaded nut threaded onto said bolt.

18. The hardware of claim 17 wherein said resilient material is an elongated rubber bushing.

* * * * *